US005879187A

United States Patent [19]

Cheng et al.

[11] Patent Number: 5,879,187

[45] Date of Patent: Mar. 9, 1999

[54] PAIR OF MOUNTING EARS BY TWO SIDES OF PROJECTION BAR

[75] Inventors: Lee-Ming Cheng, Cupertino; Chiu-Yu Tang, San Jose; Edmond Choy, Union City, all of Calif.; George Lee, Taipei, Taiwan

[73] Assignee: Hon Hai Precision Ind. Co., Ltd., Taipei Hsien, Taiwan

[21] Appl. No.: 879,324

[22] Filed: Jun. 20, 1997

[51] Int. Cl.[6] ..... H01R 13/73

[52] U.S. Cl. ..... 439/570

[58] Field of Search ..... 439/570, 569, 439/571–573, 83

[56] References Cited

U.S. PATENT DOCUMENTS

| | | | |
|---|---|---|---|
| 5,232,379 | 8/1993 | Lai | 439/570 |
| 5,316,486 | 5/1994 | Tanaka et al. | 439/496 |
| 5,622,519 | 4/1997 | Bixler et al. | 439/570 |

*Primary Examiner*—Gary F. Paumen

[57] ABSTRACT

A connector (10) includes a housing (12) defining a plurality of passageways (16) for receiving a corresponding number of contacts therein. The housing (12) further includes three projection bars (20) extending rearward from a rear surface (18) of the housing (12) for protectively accommodating the corresponding plural contact tails therebetween. A mounting device (22) includes a pair of individual mounting ears (24, 24') which are relatively closely side by side positioned within two juxtaposed slots (38, 38') of the housing (12) wherein each mounting ear (24, 24') has a retention section (28, 28') interferentially embedded within a retention slit (44, 44') for fastening the mounting ear (24, 24') to the housing (12), and an L-shaped mounting section (32, 32') closely beside one side surface (36, 36') of the bar (20). These two mounting ears (24, 24') are compactly and closely arranged to be side by side positioned with each other and also spaced away from each other by a thin divider wall (42) of the housing (12). These two mounting ears (24, 24') are of a pair of mirror images with each other so that the two L-shaped mounting sections (32, 32') of the two mounting ears (24, 24') can respectively abut against two opposite side wall surface (36, 36') of each bar (20).

6 Claims, 4 Drawing Sheets

PAIR OF MOUNTING EARS BY TWO SIDES OF PROJECTION BAR

BACKGROUND OF THE INVENTION

1. Field of the Invention

The invention relates to mounting means for use with the connector which is seated on a PC board, and particularly to a pair of mounting ears snugly arranged by two sides of a rearward projection bar of the connector.

2. The Related Art

Most conventional SMT type (Surface Mount Technology) connectors are fastened to a PC board by a pair of mounting ears respectively at two opposite ends of the housing of the connector, for example, U.S. Pat. No. 5,232,379. It is also noted that for compliance with different circuit layout design on the PC board, sometimes, each mounting device may require two soldering ears by two sides of the housing so as to reinforce the fastening of the connector housing with regard to the PC board on which the connector is seated, for example, U.S. Pat. No. 5,316,486.

Recently, a new type connector called "Device Bay" is publicly announced and will be designated as a standard matter in this field whereof the plug set is configured to be as shown in FIG. 1 wherein the housing has three rearward projection bars for protectively accommodating the tails of the corresponding plural contacts of the plug set.

To reliably and efficiently evenly fasten the connector to the board, a pair of mounting ears are desired for each projection bar for soldering with the corresponding pads on the board.

Understandably, using one mounting device having two integral soldering ears laterally extending on two sides against the housing as shown in the aforementioned U.S. Pat. No. 5,316,486, sometimes is not reliable. It is because if the retention tag of such mounting device has not correctly interferentially retained within the corresponding retaining slot of the housing, the two soldering ears may both lose their true positions with regard to the corresponding soldering pads on the board.

Therefore, an object of the invention is to provide a mounting device consisting of a pair of closely juxtaposed mounting ears which may be easily installed into the housing of the connector and achieve reliable and independent retention of the connector to the board.

SUMMARY OF THE INVENTION

According to an aspect of the invention, a connector includes a housing defining a plurality of passageways for receiving a corresponding number of contacts therein. The housing further includes three projection bars extending rearward from a rear surface of the housing for protectively accommodating the corresponding plural contact tails therebetween. A mounting device includes a pair of individual mounting ears which are relatively closely side by side positioned within two juxtaposed slots of the housing wherein each mounting ear has a retention section interferentially embedded within a retention slit for fastening the mounting ear to the housing, and an L-shaped mounting section closely beside one side surface of the bar. These two mounting ears are compactly and closely arranged to be side by side positioned with each other and also spaced away from each other by a thin divider wall of the housing. These two mounting ears are of a pair of mirror images with each other so that the two L-shaped mounting sections of the two mounting ears can respectively abut against two opposite side walls of each bar.

DETAILED DESCRIPTION OF THE PREFERRED EMBODIMENTS

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 1:
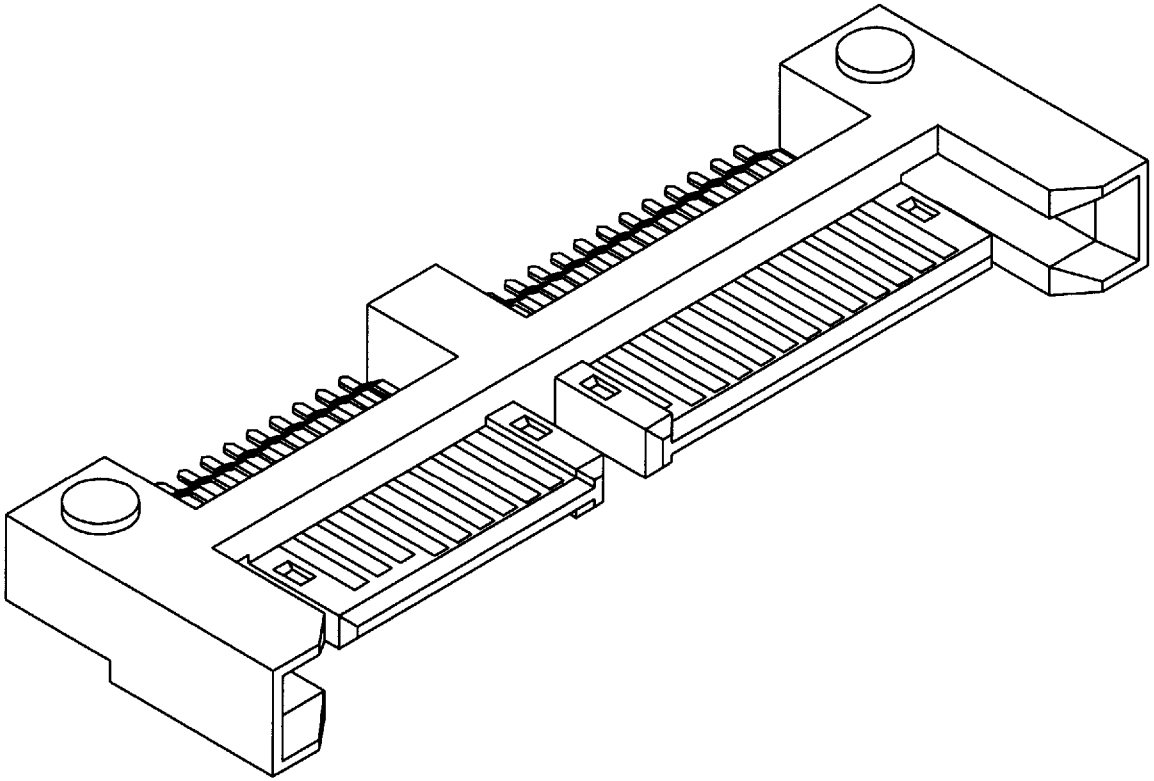
FIG. 1 is a front perspective view of a proposed connector which is expected to be a standard design in the computer field.
Figure 2:
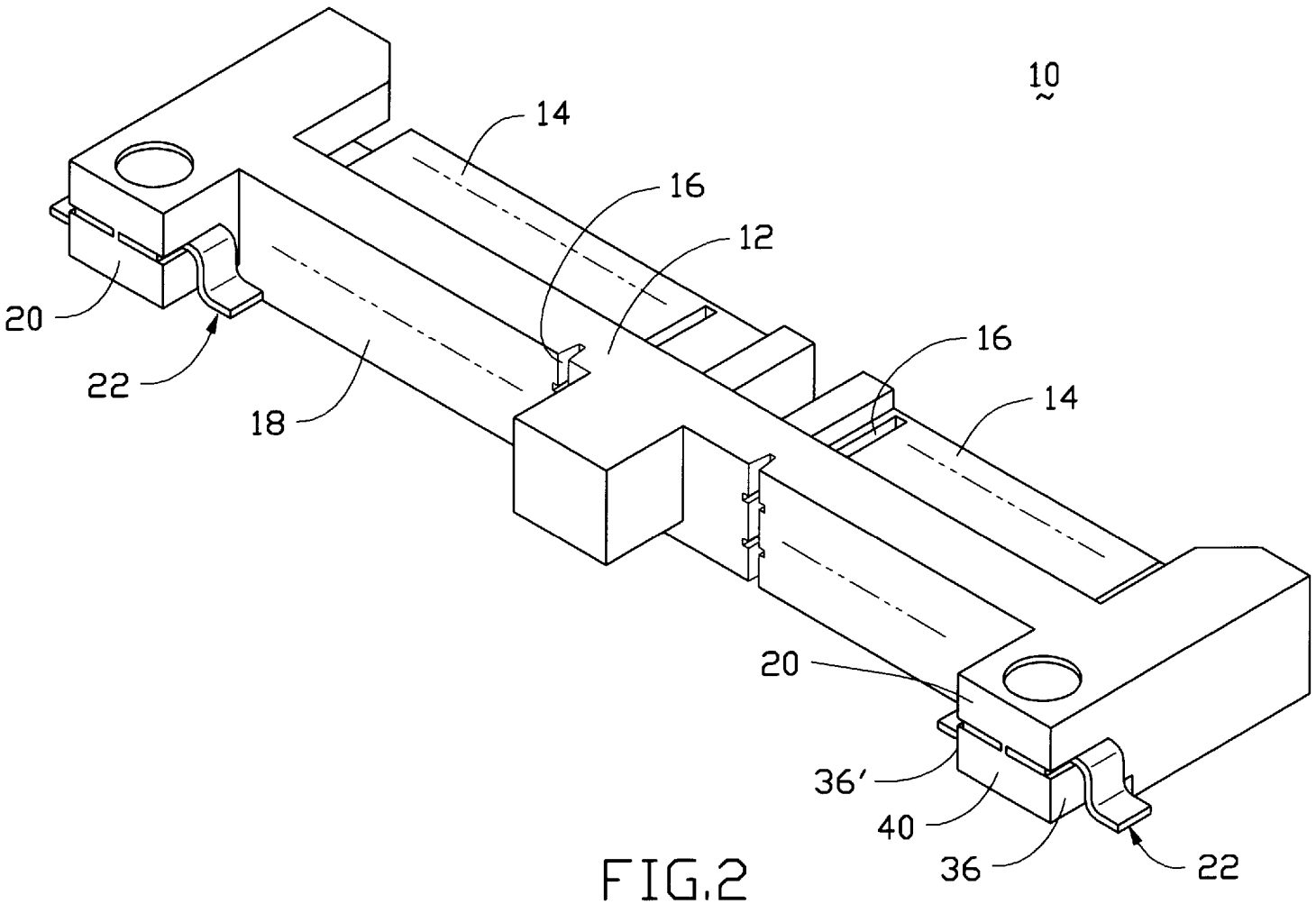
FIG. 2 is a back perspective view of an assembled connector of FIG. 1 without contacts therein to show the mounting ears already embedded within the housing of the connector.
Figure 3:
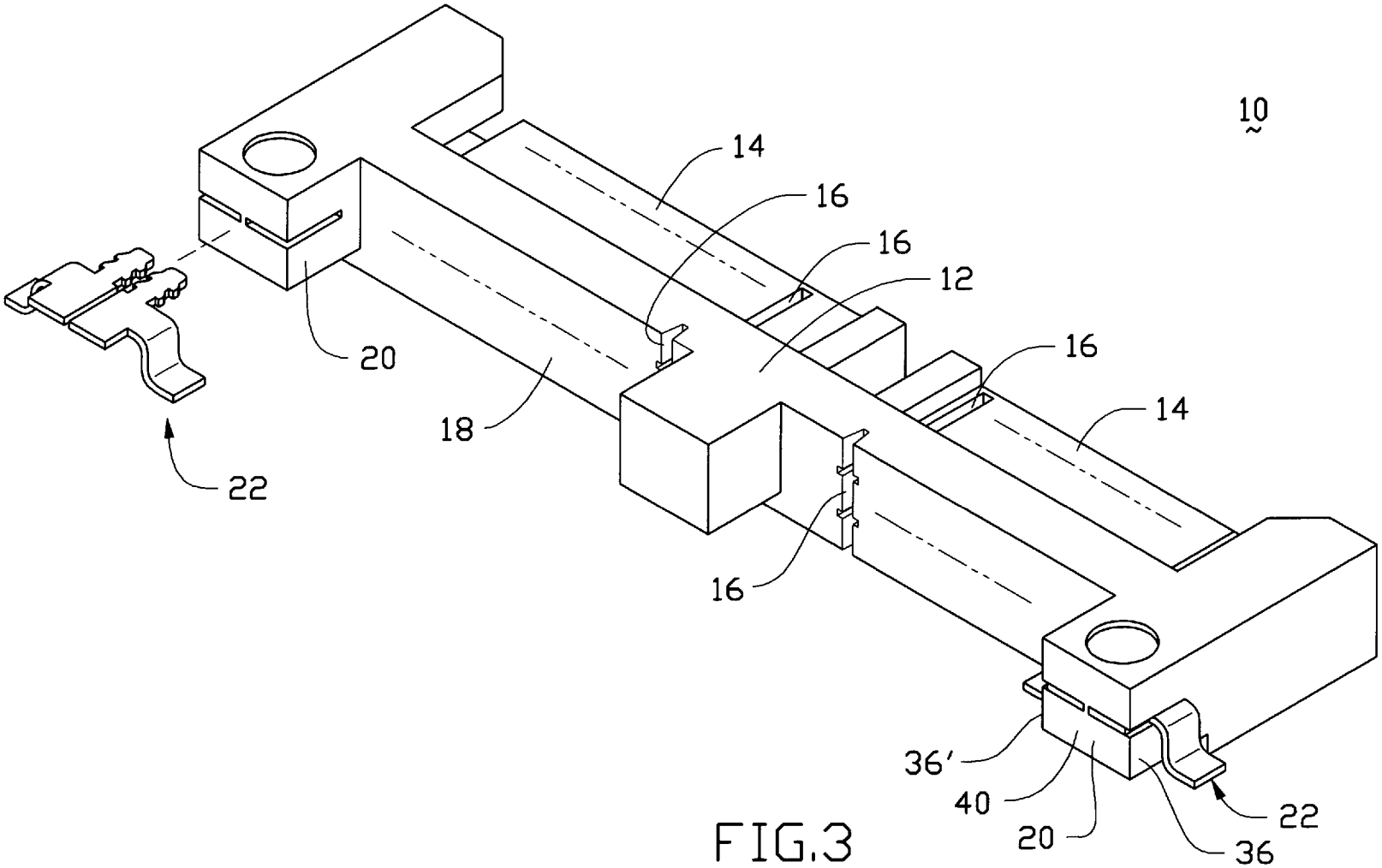
FIG. 3 is an exploded perspective view of the connector of FIG. 2 to show the removed mounting ears therefrom.
Figure 4:
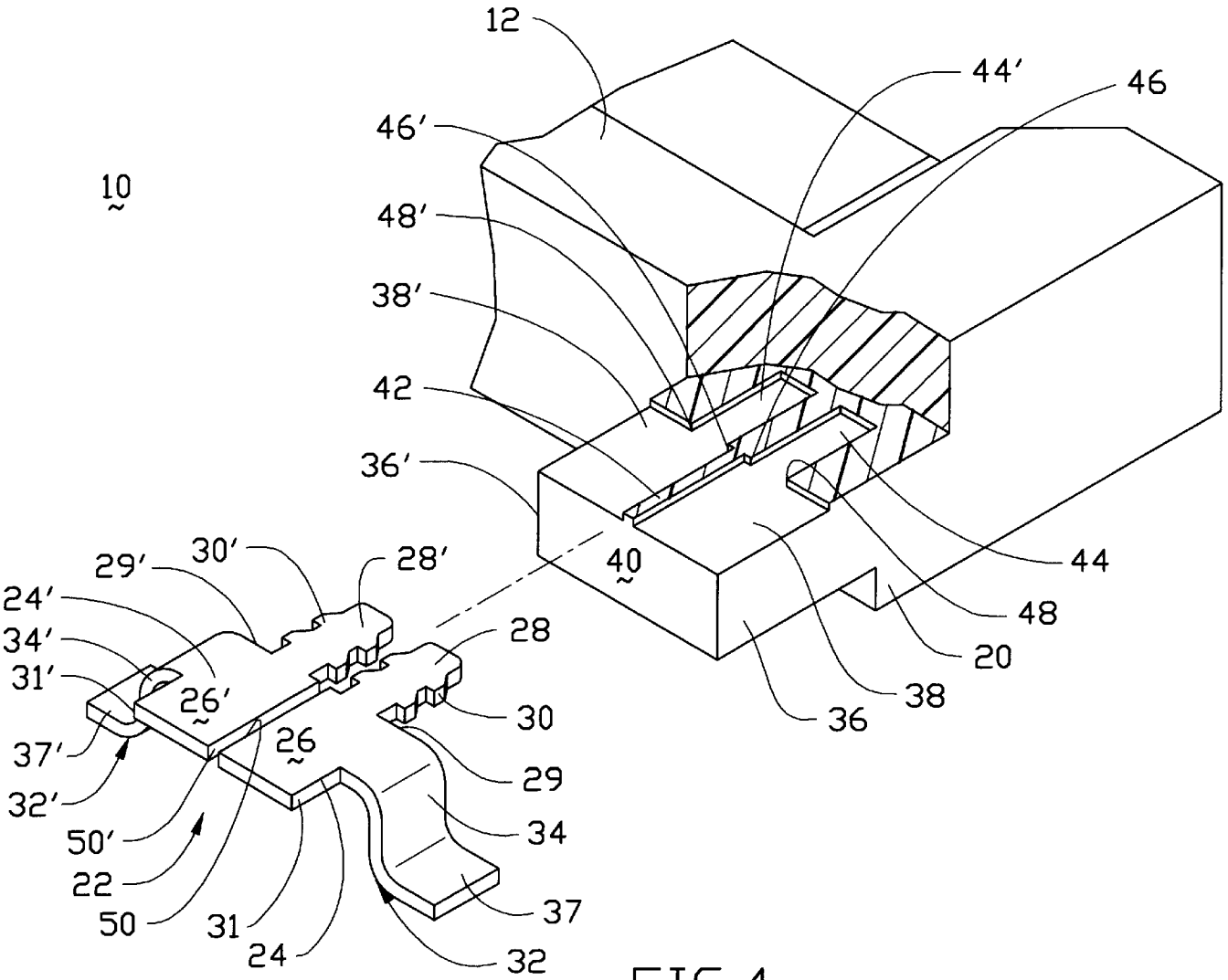
FIG. 4 is a fragmentary perspective view of the connector of FIG. 2 to show the interior structure of the housing for illustrating how the mounting ear can be retained with the housing.

It will be noted here that for a better understanding, most of like components are designated by like reference numerals throughout the various figures in the embodiments. Attention is directed to FIGS. 2–4 wherein a plug connector 10 includes an insulative housing 12 defining two forward mating sections 14 with a plurality of passageways 16 extending therethrough to a rear surface 18 for receiving therein a corresponding number of contacts (see FIG. 1) wherein the contact tails extend out of the rear surface 18 for SMT soldering to the board (not shown).

To efficiently and reliable protect the contact tails and prevent any lateral impact imposed unto the contact tails, three projection bars 20 rearward extending from the rear surface 18. Also, to have the connector 10 stably sit on the board, two mounting device 22 are respectively installed to two opposite outermost projection bars 20 for soldering to the board.

Each mounting device 22 consists of a pair of mounting ears 24(24') wherein each mounting ear 24(24') includes a main plate 26(26'), a retention section 28(28'), with barbs 30(30') thereon, extending forward from a front edge 29(29') thereof, and an L-shaped mounting section 32(32') downward extending from one outer side edge 31(31') thereof. The L-shaped mounting section 32(32') includes a vertical portion 34(34') generally abutting against the corresponding side surface 36(36') of the bar 20, and horizontal portion 37(37') adapted to be soldered unto the corresponding solder pad on the board.

Correspondingly, the housing 12 defines a pair of receiving horizontal slots 38(38') generally extending inward from the back surface 40 of the bar 20 to an predetermined distance. These two slots 38(38') are divided by a thinner divider 42 so that these two slots 38(38') are not communicative with each other. Each slot 38(38') includes a retention slit 44(44') on the front portion for interferential engagement with the barbed retention section 28(28') of the mounting ear 24(24'), thus fastening the mounting ear 24(24') to the housing 12. There are two steps 46(46'), 48(48') positioned adjacent two sides of the retention slit 44(44') for restraining further forward movement of the mounting ear 24(24').

It can be seen that these two slots 38(38') are mirror images with each other along the divider 42, and then the mounting ears 24(24') respectively installed within the respective slots 38(38') are also mirror images with each other.

Therefore, the right mounting ear 24 can be assembled to the right slot 38 from the back surface 40 of the bar 22 wherein the retention section 28 is interferentially engaged within the corresponding slit 44, the inner edge 50 of the mounting ear 24 abuts against the right side of the divider 42, and the vertical portion 34 abuts against the right side surface 36 of the bar 22. Oppositely, the left mounting ear 22' can be assembled to the left slot 38' from the back surface 40 of the bar 22 wherein the retention section 28' is interferentially engaged within the corresponding slit 44', the inner edge 50' of the mounting ear 24' abuts against the left side of the divider 42, and the vertical portion 34' abuts against the left side surface 36' of the bar 22.

It is appreciated that the two mounting ears 24, 24' can be compactly but independently cooperate with one projection bar 20 for providing two individual solder sections by two sides of the bar 20. Therefore, even one mounting ear 24/24' may have an imperfect assembling with the housing 12, the other one still provides a good fixation performance with the connector 10 to the board. Therefore, the whole connector 10 still maintains an acceptable mounting condition because each projection bar 20 has at least one horizontal portion 37(37') adapted to be solderably mounted to the corresponding soldering pad on the board.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A connector comprising:

an insulative housing having a plurality of contacts therein;

at least one projection bar extending rearward at one end of said housing for protecting contact tails of said contacts from any lateral impact, said projection bar defining a right side and a left side thereof;

a mounting device including a pair of separate and independent one of the mounting ears closely side by side positioned within said projection bar wherein a first mounting ear is positioned on the right side of the projection bar and a second mounting ear is positioned on the left side of the projection bar, and each mounting ear has its own L-shaped mounting section including a vertical portion and a horizontal portion, whereby the vertical portion of the first mounting ear abuts against a right side surface of the projection bar, and the vertical portion of the second mounting ear abuts against a left side surface of the projection bar.

2. The connector as defined in claim 1, wherein the housing has a pair of closely juxtaposed horizontal slots for receiving said two side by side mounting ears, said two slots being separated by a thin divider.

3. The connector as defined in claim 2, wherein each slot includes a slit on a front portion thereof for receiving a retention section of the corresponding mounting ear.

4. The connector as defined in claim 3, wherein said slit further includes a pair of steps for confronting a main plate of the corresponding mounting ear.

5. A connector comprising:

an insulative housing defining at least one rearward extending projection bar;

a pair of closely side by side separate horizontal slots arranged to be independent from and uncommunicative with each other; and a pair of mounting ears independently received within corresponding ones of the slots; wherein said two mounting ears are mirror images with each other so that one of the mounting ear abuts against a right side surface of the projection bar and the other mounting ear abuts against a left side surface of the projection bar.

6. The connector as defined in claim 5, wherein said two separate slots are segregated by a thin divider whereby a first inner edge of said one mounting ear confronts a right side of the divider and a second inner edge of said other mounting ear confronts a left side of the divider.

* * * * *